US009010125B2

(12) United States Patent
Morrison et al.

(10) Patent No.: US 9,010,125 B2
(45) Date of Patent: Apr. 21, 2015

(54) REGENERATIVELY COOLED TRANSITION DUCT WITH TRANSVERSELY BUFFERED IMPINGEMENT NOZZLES

(71) Applicants: Jay A. Morrison, Titusville, FL (US); Ching-Pang Lee, Cincinnati, PA (US); Michael E. Crawford, Oviedo, FL (US)

(72) Inventors: Jay A. Morrison, Titusville, FL (US); Ching-Pang Lee, Cincinnati, PA (US); Michael E. Crawford, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 13/956,405

(22) Filed: Aug. 1, 2013

(65) Prior Publication Data

US 2015/0033697 A1 Feb. 5, 2015

(51) Int. Cl.
*F01D 9/02* (2006.01)

(52) U.S. Cl.
CPC ..... *F01D 9/023* (2013.01)

(58) Field of Classification Search
CPC ..... F01D 9/023
USPC ..... 60/752–760
See application file for complete search history.

(56) References Cited

U.S. PATENT DOCUMENTS

| | | | | |
|---|---|---|---|---|
| 4,872,312 | A * | 10/1989 | Iizuka et al. | 60/760 |
| 4,916,906 | A | 4/1990 | Vogt | |
| 5,265,409 | A | 11/1993 | Smith, Jr. et al. | |
| 5,352,091 | A | 10/1994 | Sylvestro | |
| 5,388,412 | A | 2/1995 | Schulte-Werning et al. | |
| 5,533,864 | A | 7/1996 | Nomoto et al. | |
| 5,586,866 | A | 12/1996 | Wettstein | |
| 5,749,229 | A | 5/1998 | Abuaf et al. | |
| 5,960,632 | A | 10/1999 | Abuaf et al. | |
| 6,000,908 | A | 12/1999 | Bunker | |
| 6,237,344 | B1 | 5/2001 | Lee | |
| 6,439,846 | B1 | 8/2002 | Anderson et al. | |
| 6,484,505 | B1 | 11/2002 | Brown et al. | |
| 6,554,563 | B2 | 4/2003 | Noe et al. | |
| 6,615,588 | B2 | 9/2003 | Hoecker | |
| 7,493,767 | B2 * | 2/2009 | Bunker et al. | 60/752 |
| 7,721,547 | B2 * | 5/2010 | Bancalari et al. | 60/752 |
| 7,908,867 | B2 * | 3/2011 | Keller et al. | 60/753 |
| 2008/0271458 | A1 | 11/2008 | Ekkad et al. | |
| 2010/0300107 | A1 * | 12/2010 | Barton et al. | 60/772 |
| 2012/0272521 | A1 * | 11/2012 | Lee et al. | 29/888.01 |
| 2012/0275900 | A1 * | 11/2012 | Snider et al. | 415/108 |
| 2013/0133330 | A1 * | 5/2013 | Laster et al. | 60/752 |
| 2014/0109577 | A1 * | 4/2014 | Lee et al. | 60/722 |

FOREIGN PATENT DOCUMENTS

| | | | |
|---|---|---|---|
| DE | 102010060286 | A1 | 5/2011 |
| EP | 0239020 | A2 | 9/1987 |

(Continued)

*Primary Examiner* — William H Rodriguez
*Assistant Examiner* — Carlos A Rivera

(57) ABSTRACT

A cooling arrangement (56) having: a duct (30) configured to receive hot gases (16) from a combustor; and a flow sleeve (50) surrounding the duct and defining a cooling plenum (52) there between, wherein the flow sleeve is configured to form impingement cooling jets (70) emanating from dimples (82) in the flow sleeve effective to predominately cool the duct in an impingement cooling zone (60), and wherein the flow sleeve defines a convection cooling zone (64) effective to cool the duct solely via a cross-flow (76), the cross-flow comprising cooling fluid (72) exhausting from the impingement cooling zone. In the impingement cooling zone an undimpled portion (84) of the flow sleeve tapers away from the duct as the undimpled portion nears the convection cooling zone. The flow sleeve is configured to effect a greater velocity of the cross-flow in the convection cooling zone than in the impingement cooling zone.

17 Claims, 2 Drawing Sheets

(56) References Cited

FOREIGN PATENT DOCUMENTS

| | | | |
|---|---|---|---|
| EP | 0698725 | A2 | 2/1996 |
| EP | 0896193 | A2 | 2/1999 |
| EP | 2369235 | A2 | 9/2011 |
| EP | 2439452 | A2 | 4/2012 |
| EP | 2469033 | A2 | 6/2012 |

* cited by examiner

REGENERATIVELY COOLED TRANSITION DUCT WITH TRANSVERSELY BUFFERED IMPINGEMENT NOZZLES

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates to a cooling arrangement for a hot gas duct having significantly varying cooling requirements along its length.

BACKGROUND OF THE INVENTION

Conventional gas turbine engines utilizing a can-annular combustion arrangement include a transition duct that receives hot combustion gases from a combustor can and guides the combustion gases toward a turbine inlet. Typically a guide vane between the downstream end of the transition duct and the turbine rotor inlet orients the hot gases for delivery onto the first row of turbine blades. The hot gases exhausting from the combustor outlet typically flow below 0.2 mach. The hot gases accelerate slightly as they travel within the transition duct, but most of the acceleration occurs as the hot gases flow through the guide vanes, where the hot gases are accelerated to approximately 0.7-0.9 mach.

Cooling requirements for the transition duct are influenced by the speed of the hot gases flowing through the transition duct. Since the speed of the hot gases flowing through conventional transition ducts remains reasonably constant along the length of the transition duct, conventional transition duct cooling arrangements have been designed to remove heat at relatively constant rates along the length of the transition duct.

In contrast to the conventional combustion arrangements, an emerging can-annular combustion arrangement reorients the combustors and directs the hot gases along a straight flow path toward the turbine inlet annulus. The associated transition duct technology uses the transition duct itself to accelerate the hot gases, thereby eliminating the guide vanes conventionally placed between the transition duct and the turbine rotor inlet. Accelerating the combustion gases within the transition duct increases the amount of heat transferred to the transition duct in those regions where the hot gases flow faster. Consequently, there remains room in the art for improved cooling arrangements.

BRIEF DESCRIPTION OF THE DRAWINGS

The invention is explained in the following description in view of the drawings that show.

DETAILED DESCRIPTION OF THE INVENTION

The present inventors have devised a unique cooling arrangement adapted to the unique cooling requirements for transition ducts associated with certain emerging can-annular combustion arrangements. In these combustion arrangements the combustors are oriented in a manner that permits delivery of the hot gases along a straight flow path and directly on to a first row of turbine blades via transition ducts that accelerate the hot gases and thereby eliminate the need for the conventional guide vanes immediately upstream of the turbine rotor inlet. The cooling arrangement forms various zones capable of meeting the cooling requirements or different regions of the transition duct by varying the type of cooling provided. Types of cooling provided including impingement cooling, convection cooling, and combination impingement and convection cooling.

Figure 1:
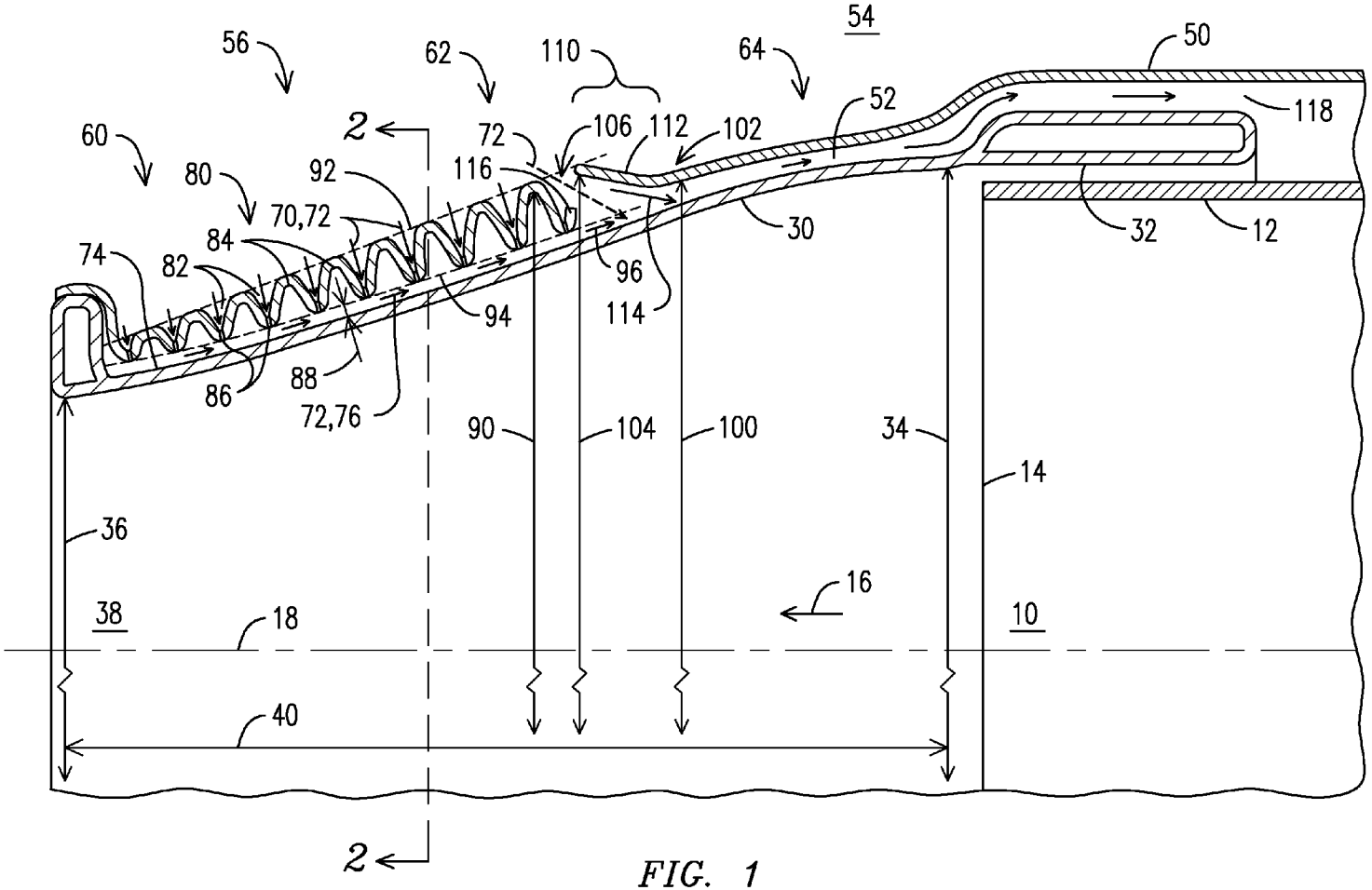
FIG. 1 is a schematic, longitudinal cross section of a cooling arrangement disclosed herein.

FIG. 1 shows a downstream end 10 of a combustor can 12 having an outlet 14 from which hot gases 16 exhaust while flowing along a straight flow axis 18. The hot gas ducting includes a transition cone 30 having an upstream end 32 that receives the downstream end 10 of the combustor can 12 and defines a passageway for the hot gases. A diameter of the transition cone 30 transitions from an inlet diameter 34 to a smaller, outlet diameter 36 at a downstream end 38. This diameter change decreases a flow area for the hot gases 16 which accelerate in response to the decreasing diameter. This convergence occurs over a cone converging length 40 that spans from the inlet diameter 34 to the outlet diameter 36.

Surrounding the transition cone 30 is a flow sleeve 50 which defines a cooling plenum 52 there between. Surrounding the flow sleeve 50 is a casing plenum 54 that contains compressed air received from the compressor and used as the cooling fluid. The cooling arrangement 56 may include an impingement cooling zone 60, an optional blended cooling zone 62, and a convection cooling zone 64. These zones represent zones of varying rates of heat transfer from the hot gases 16 to the transition cone 30. Both the impingement cooling zone 60 and the blended cooling zone 62 form a zone having impingement cooling.

In the convection cooling zone 64 hot gases 16 may be flowing at a speed below mach 0.2 and therefore transfer a relatively low amount of heat to the transition cone 30 in this zone. In the blended cooling zone 62 the diameter of the transition cone 30 decreases. This accelerates the hot gases 16 and this increased flow velocity increases the amount of heat transferred from the hot gases 16 to the transition cone 30 (i.e. the heat flux) in the blended cooling zone 62 when compared to the convection cooling zone 64. In the impingement cooling zone the diameter of the transition cone 30 continues to decrease. This continues to accelerate the hot gases 16 resulting in an even greater rate of heat transfer from the hot gases 16 to the transition cone 30 in the impingement zone 60 when compared to the blended cooling zone 62.

Readily available types of cooling include impingement cooling and convection cooling, both of which are used in the cooling arrangement 56. Impingement cooling is used in the impingement cooling zone 60 because it is extremely effective and therefore a good match for the extremely high cooling requirements of the narrowest portion of the transition cone 30 where hot gases may flow above approximately 0.5 mach. In an exemplary embodiment, in the impingement cooling zone 60 impingement cooling may be responsible for the majority of the heat removal from the transition cone 30, and convective cooling may be responsible for a minority of the heat removal. Here fast moving jets 70 of cooling fluid 72 are directed onto an outer surface 74 of the transition cone 30 to be cooled. Once spent, (i.e. post-impingement), the cooling fluid 72 becomes a cross-flow 76 of cooling fluid 72. The cross-flow 76 flows along and convectively cools the outer surface 74. However, as the cross-flow 76 flows along the outer surface 74 a volume of the cross-flow increases because more impingement jets 70 are feeding cooling fluid 72 into the cross-flow 76. This can interfere with the flow of the impingement jets 70, reducing the penetration of the impingement jets 70 to a point where the impingement cooling effect is reduced.

To reduce this interference the inventors have developed an innovative dimpled arrangement 80 where individual dimples 82 extend radially inward from an undimpled portion 84 of the flow sleeve 50, such as a sheet. Each dimple 82 includes an outlet 86 from which a respective impingement jet 70 emanates. The dimples 82 can be configured such that all outlets 86 are at any distance 88 desired from the outer surface 74. In one exemplary embodiment all of the outlets 86 are at a same distance from the outer surface 74. In an exemplary embodiment the ratio of distance 88 to diameter of the outlet 86 in the impingement cooling zone 60 may be set at 3-5. The closer the outlets 86 are to the outer surface 74, the less pressure necessary to form an effective impingement jet 70. Thus, this dimple arrangement can be used more effectively in areas where the driving pressure difference is relatively small. The dimples 82 may be aligned with each other and in a direction of the cross-flow 76 so that the cross-flow 76 is guided around the impingement jets 70 by the dimples 82 and is free to flow in the rows between the dimples. In this manner the cross-flow 76 does not interfere with the impingement jets 70.

In between the dimples 82, the undimpled portion 84 forming the cross-flow channels may be characterized by a diameter 90 having a rate of taper 92. This rate of taper 92 may be tailored with respect to a rate of taper 94 of the outer surface 74 so a cross sectional area of the cooling plenum 52 is increased, or optionally, maintained or even reduced. By increasing the cross sectional area of the cooling plenum 52, the cooling plenum 52 can be configured to maintain a same flow velocity of the cross-flow 76 along a length of the cooling plenum 52 despite the addition of cooling fluid 72 with each impingement jet 70 in a direction 96 of flow of the cross-flow 76. Having a slower flow velocity reduces an interference between the cross-flow 76 and the impingement jets 70. Alternately, the flow velocity of the cross-flow 76 could be decreased or increased based on other design considerations. This unique arrangement allows for individual tailoring of the flow velocity of the cross-flow 76 and the number of impingement jets 70 and their distance 88 from the outer surface 74. By controlling the flow velocity of the cross-flow 76 one can also control the amount of convective cooling that is achieved via the cross-flow 76. Together, the impingement cooling and the convection cooling are effective to meet the cooling requirements of the transition cone 30 in this zone that might not be met by convection cooling along.

The blended cooling zone 62 is similar to the impingement cooling zone 60 in that both impingement cooling jets 70 and cross-flow 76 convective cooling may be used, but in this zone and in an exemplary embodiment the convective cooling effects of the cross-flow 76 may be predominant, and the impingement jets 70 are responsible for a minority of the heat transfer from the transition cone 30. This blended cooling is sufficient to meet the needs of the transition cone 30 in this zone where hot gases 16 may flow at rates between approximately 0.5 mach and 0.2 mach. In an exemplary embodiment the ratio of distance 88 to diameter of the outlet 86 in the blended cooling zone 62 may be set at 3-5.

In the convective cooling zone 64 all cooling is accomplished by convection. While the cooling requirements are lowest in this zone, the cross-flow 76 must still be accelerated so it can transfer enough heat from the transition cone 30. Consequently, in this zone the flow velocity of the cross-flow 76 is greater than the flow velocity of the cross-flow 76 in the impingement cooling zone 60 and in the blended cooling zone 64. The acceleration of the cross-flow 76 can be accomplished in at least two ways. In a first configuration a cross sectional area of the cooling plenum 52 may be reduced in the convection cooling zone 60 and this will accelerate the cross-flow 76 to the desired flow velocity. This may be accomplished in an exemplary embodiment by having a diameter 100 at an upstream end 102 of the convection cooling zone 64 be less than a diameter 104 of the undimpled portion 84 immediately upstream of the upstream end 102 of the convection cooling zone 64 with respect to a direction of flow of the cross-flow 76.

Alternately, or in addition, a flow sleeve opening 106 may be positioned to allow cooling fluid 72 into the convection zone 64. The increased volume of cooling fluid will cause the cross-flow velocity to increase. The increase can be tailored as necessary by sizing the size of the flow sleeve opening 106 alone or together with the diameter 100 at the upstream end 102 of the convection cooling zone 64 or anywhere else in the convection cooling zone 64 as desired. Alternately, or in addition, the flow sleeve opening 106 may be angled as shown so that a momentum of the cooling fuild 72 traveling through the flow sleeve opening 106 and entering the cross-flow 76 may contribute to an acceleration of the cross-flow 76.

In a transition region 110 between the blended cooling zone 62 and the convection cooling zone 64 the flow sleeve 50 may be configured to take advantage of the changing diameters of the flow sleeve 50. For example, a ramp 112 may be formed that directs circumferential portions of all of the converging cross-flow 76 toward the transition cone 30 as indicated by arrow 114. This ramp 112 can be configured at any angle desired or may undulate circumferentially, resulting in regions of greater and lesser impact on the transition cone 30 circumferentially. Such circumferential undulation may be a natural result of the last circumferential ring 116 of dimples 82.

Cooling fluid 72 exhausting from an outlet 118 of the convection cooling zone 64 may exhaust into an inlet of the combustor and used for further cooling and/or combustion.

Figure 2:
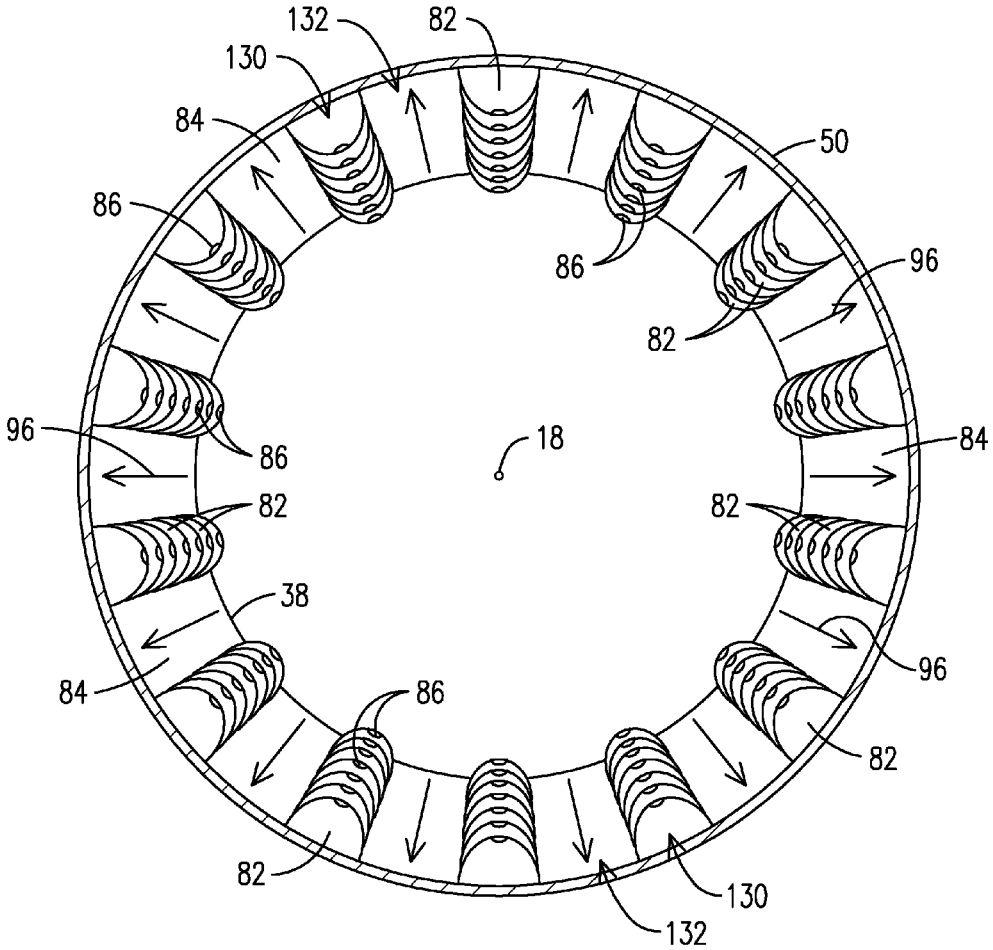
FIG. 2 is a schematic cross-section of the flow sleeve taken along line 2-2 of FIG. 1.

FIG. 2 shows a cross section of the flow sleeve 50 alone, looking downstream along the flow axis 18. Visible are the dimples 82, outlets 86, and undimpled portions 84 of the flow sleeve 50. In this view it is apparent that the dimples 82 may align with the direction 96 of flow of the cross-flow 76 to form rows 130 of dimples, leaving cross-flow channels 132 there between in which the cross-flow 76 can flow and avoid the impingement jets 70. The cross-flow channels 132 are open and allow for the cross-flow 76 to flow unimpeded. This reduces a pressure drop in the flow sleeve which, in turn, increases engine efficiency. Alternately, the dimples may be spaced in alternating rows for more effective and uniform impingement cooling. Cross flow effects on the impingement jets can be minimized by increasing further the spacing of the undimpled portion of the flow sleeve.

From the foregoing it is apparent that the inventors have devised an innovative solution to new cooling requirements created by a new combustion arrangement. The cooling arrangement is responsive to the much greater variation in cooling requirements of different regions of the duct than exists in prior art combustion arrangements. Consequently, the cooling arrangement is able to satisfy the varying cooling needs of these regions, but does so using cooling fluid in a much more efficient manner than would be possible if the prior art cooling arrangements were applied. Thus, the cooling arrangement represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A cooling arrangement, comprising:

a duct configured to receive hot gases from a combustor can; and a flow sleeve surrounding the duct and defining a cooling plenum there between, wherein the flow sleeve is configured to form impingement cooling jets emanating from dimples in the flow sleeve effective to cool the duct in a first zone having impingement cooling, and wherein the flow sleeve is configured to form a convection cooling zone effective to cool the duct solely via a cross-flow, the cross-flow comprising spent impingement cooling fluid from the impingement cooling jets, and the cross-flow flowing from the first zone having impingement cooling into the convection cooling zone, wherein in the first zone having impingement cooling, an undimpled portion of the flow sleeve tapers away from the duct as the undimpled portion nears the convection cooling zone, wherein a cross-sectional flow area of the cooling plenum decreases in the convection cooling zone and the decreased cross-sectional flow area is effective to accelerate the cross-flow to a greater velocity in the convection cooling zone than a velocity of a cross-flow in the first zone having impingement cooling, and wherein the convection cooling zone is disposed downstream of an outlet of the combustor can with respect to a direction of flow of the hot gases.

2. The cooling arrangement of claim 1, wherein the dimples form rows aligned with a direction of flow of the cross-flow, and wherein the cross-flow is directed between the rows.

3. The cooling arrangement of claim 1, wherein each dimple comprises an outlet for a respective impingement jet, and wherein all of the outlets are disposed at a same distance from the duct.

4. The cooling arrangement of claim 1, wherein the flow sleeve comprises an opening there through effective to allow cooling fluid from a casing plenum surrounding the flow sleeve to enter the convection cooling zone.

5. The cooling arrangement of claim 4, wherein the flow sleeve opening is configured to direct the cooling fluid from the casing plenum into the cross-flow so a momentum of the cooling fluid from the casing plenum contributes to the acceleration of the cross-flow to the greater velocity.

6. The cooling arrangement of claim 1, wherein a diameter of the flow sleeve at an upstream end of the convection cooling zone with respect to a direction of flow of the cross-flow is less than a diameter of the undimpled portion of the flow sleeve between the dimples and immediately upstream of the upstream end of the convection cooling zone.

7. The cooling arrangement of claim 1, wherein the first zone having impingement cooling comprises a blended cooling zone disposed between an impingement cooling zone and the convection cooling zone, wherein in the impingement cooling zone the impingement cooling jets predominately cool, wherein in the blended cooling zone: the undimpled portion of the flow sleeve tapers away from the duct as the undimpled portion nears the convection cooling zone; and the flow sleeve is effective to predominately cool the duct with the cooling fluid exhausting from the impingement cooling zone and secondarily cool the duct with impingement cooling jets emanating from the dimples in the flow sleeve and disposed in the blended cooling zone.

8. A cooling arrangement, comprising:

a duct defining a constricting passageway configured to receive hot gases from a combustor can and configured to accelerate the hot gases from below mach 0.2 to above mach 0.5; and a flow sleeve surrounding the duct and defining a cooling plenum there between, wherein in an impingement cooling zone the flow sleeve is configured to predominately cool, via impingements jets, a first portion of the duct constraining hot gases traveling above mach 0.5, wherein in the impingement cooling zone the flow sleeve comprises inwardly pointing dimples configured to form impingement jets and an undimpled portion there between, wherein the undimpled portion of the flow sleeve tapers away from the duct as the undimpled portion nears a convection cooling zone, wherein in convection cooling zone the flow sleeve is configured to cool solely via convection cooling a second portion of the duct constraining hot gases traveling below mach 0.2, wherein the convection cooling zone is disposed downstream of an outlet of the combustor can with respect to a direction of flow of the hot gases, and wherein the flow sleeve is configured to increase a cross-flow velocity of cooling fluid in the convection cooling zone when compared to a cross-flow velocity in the impingement cooling zone, wherein a cross-sectional flow area of the cooling plenum decreases in the convection cooling zone and the decreased cross-sectional flow area is effective to increase the cross-flow velocity.

9. The cooling arrangement of claim 8, wherein a cross-sectional flow area of the cooling plenum in the impingement cooling zone increases toward the convection cooling zone.

10. The cooling arrangement of claim 9, wherein the inwardly pointing dimples form rows aligned with a direction of flow of the cross-flow, and wherein the cross-flow is directed between the rows.

11. The cooling arrangement of claim 9, wherein the flow sleeve further comprises an opening there through effective to allow cooling fluid from a casing plenum surrounding the flow sleeve to enter the convection cooling zone, and an increased volume of cooling fluid in the cooling plenum is effective to increase the cross-flow velocity.

12. The cooling arrangement of claim 8, wherein in a blended cooling zone between the impingement cooling zone and the convection cooling zone the flow sleeve is configured: to predominately cool the duct with convective cooling using cooling fluid exhausting from the impingement cooling zone; and to secondarily cool the duct with impingement cooling jet emanating from dimples disposed in the blended cooling zone and projecting from the flow sleeve.

13. The cooling arrangement of claim 12, wherein in the blended cooling zone the cross-sectional flow area of the cooling plenum increases toward the convection cooling zone.

14. The cooling arrangement of claim 9, wherein a diameter of the flow sleeve at an upstream end of the convection cooling zone with respect to the direction of flow of the hot gases is less than a diameter of the undimpled portion of the flow sleeve between the dimples and immediately upstream of the upstream end of the convection cooling zone.

15. A cooling arrangement, comprising:

a duct defining a passageway configured to receive and to accelerate hot gases from a combustor can; and a flow sleeve surrounding the duct and defining a cooling plenum there between, wherein the duct and flow sleeve define: an impingement cooling zone in which the hot gases flow above 0.5 mach and the duct is cooled via impingement cooling; and a convection cooling zone in which the hot gases flow below 0.2 mach and the duct is solely cooled via convection cooling, wherein in the impingement cooling zone the flow sleeve comprises inwardly pointing dimples configured to form impingement jets and an undimpled portion there between, wherein the undimpled portion of the flow sleeve tapers away from the duct as the undimpled portion nears the convection cooling zone, wherein in the impingement cooling zone the flow sleeve comprises inwardly pointing dimples configured to form impingement jets and an undimpled portion there between, wherein the convection cooling zone is disposed downstream of an outlet of the combustor can with respect to a direction of flow of the hot gases, and wherein the flow sleeve is configured to generate a velocity of cooling fluid in the convection cooling zone that is greater than a velocity of a cross-flow of cooling fluid in the impingement cooling zone via reduced cross sectional flow area in the convection cooling zone.

16. The cooling arrangement of claim 15, wherein the duct and flow sleeve further define a blended cooling zone between the impingement cooling zone and the convection cooling zone in which the duct is cooled predominantly via the cross-flow and secondarily by impingement cooling jets.

17. The cooling arrangement of claim 15, the flow sleeve further comprising a flow sleeve opening there through effective to allow cooling fluid from a casing plenum surrounding the flow sleeve to enter the convection cooling zone.

* * * * *